United States Patent [19]

McIntyre

[11] 3,979,254

[45] Sept. 7, 1976

[54] SECONDARY HEADBOX FOR OVERLAY APPLICATION IN BOARD FORMATION

[75] Inventor: Howard L. McIntyre, Lancaster, Pa.

[73] Assignee: Armstrong Cork Company, Lancaster, Pa.

[22] Filed: Apr. 6, 1973

[21] Appl. No.: 348,752

[52] U.S. Cl. ..... 162/299; 162/342; 162/346

[51] Int. Cl.[2] ..... D21F 1/00

[58] Field of Search ..... 162/300, 342, 343, 346, 162/298, 299, 336

[56] References Cited

UNITED STATES PATENTS

| | | | |
|---|---|---|---|
| 1,727,928 | 9/1929 | Berry | 162/342 |
| 2,390,977 | 12/1945 | Williams | 162/342 |
| 2,782,692 | 2/1957 | Boronow et al. | 162/299 |

FOREIGN PATENTS OR APPLICATIONS

| | | | |
|---|---|---|---|
| 895,169 | 1945 | France | 162/299 |

*Primary Examiner*—S. Leon Bashore
*Assistant Examiner*—Peter Chin

[57] ABSTRACT

A secondary headbox is described which is capable of handling water slurries of relatively high solids consistencies and applying the slurries to a base sheet as it is being formed on conventional fourdrinier equipment in the manufacture of a board product. The secondary headbox includes means whereby the slurry is mixed and evenly distributed across its width and means whereby the thus treated slurry is further treated to remove any turbulence and to controllably feed the slurry onto the base sheet on a fourdrinier wire passing beneath the secondary headbox.

3 Claims, 1 Drawing Figure

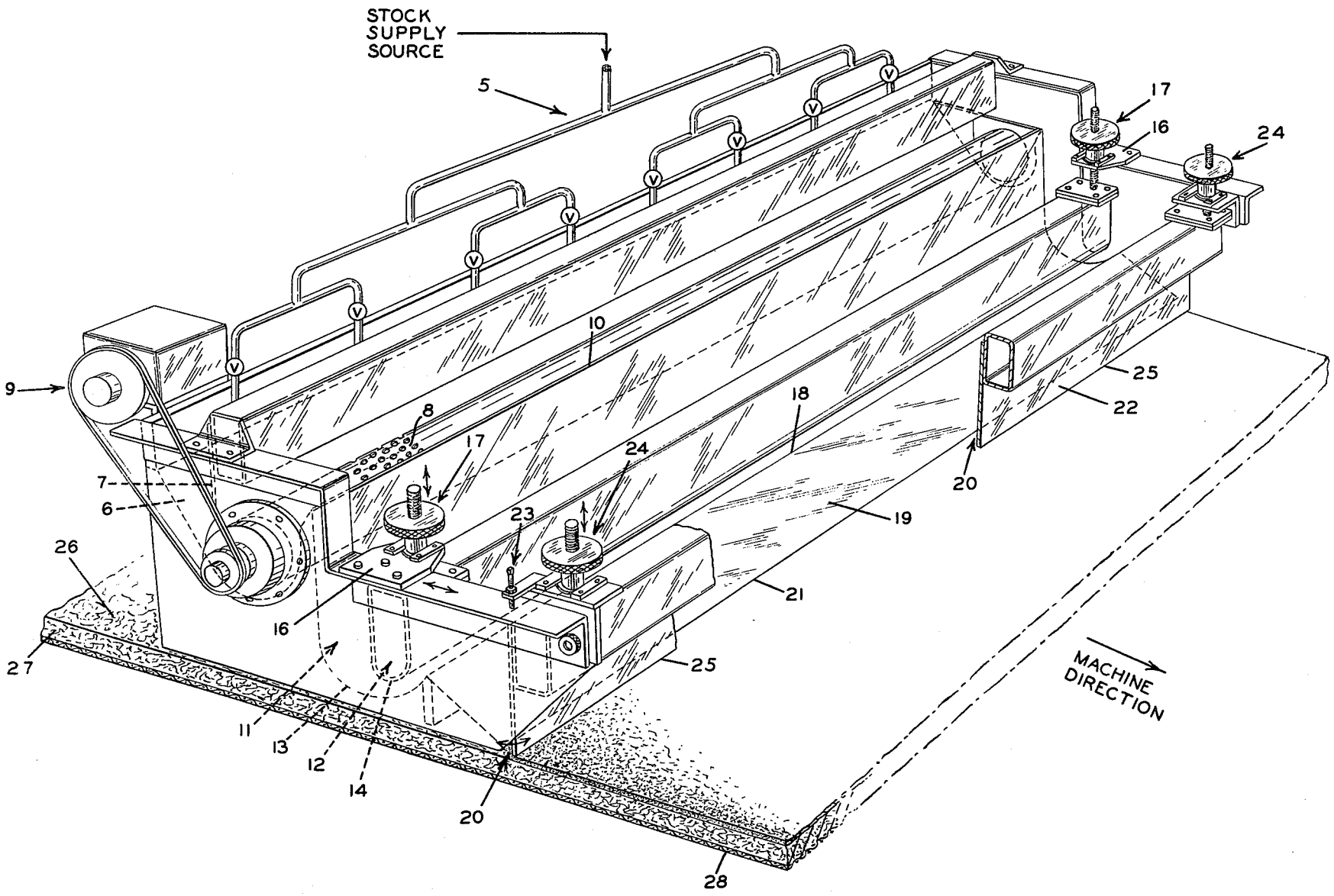
STOCK SUPPLY SOURCE
MACHINE DIRECTION
5
6
7
8
9
10
11
12
13
14
16
17
18
19
20
21
22
23
24
25
26
27
28

SECONDARY HEADBOX FOR OVERLAY APPLICATION IN BOARD FORMATION

BACKGROUND OF THE INVENTION

1. Field of the Invention

The invention relates generally to the board forming art and more specifically to a device adapted to lay-up relatively high solids slurries on a base sheet conventionally formed on a fourdrinier.

2. Description of the Prior Art

Secondary headboxes exist in the papermaking art and generally comprise a pressure system designed for delivering low solids slurries (typical paper stock) to a narrow nip opening from which the stock flows onto a base paper sheet being formed on a conventional fourdrinier wire. Commercially available secondary headboxes designed for use in papermaking have been found to be completely inadequate for handling the slurries containing high solids concentrations necessary in forming mineral fiber-board products having high density overlays.

SUMMARY OF THE INVENTION

This invention is concerned broadly with the formation of relatively low density mineral board products faced with a denser surfacing layer or overlay and more particularly with the design of a secondary headbox which enables the handling and application of slurries of high solids concentrations to a low density base stock forming on a conventional fourdrinier wire passing under the secondary headbox. The secondary headbox comprises a slurry feed header, a first chamber into which the slurry is fed and in which is positioned an underflow baffle under which the slurry first flows and a driven perforated roll through which the slurry flows and in which it is mixed and evenly distributed across the width of the headbox. From the perforated roll, the slurry passes over a weir into a second chamber containing a baffle whose lower edge configuration conforms to the hydraulic flow of the slurry passing through the second chamber. The baffle is adjustable relative to the wall of the second chamber to control flow rate and reduce slurry turbulence. The slurry then passes over a second weir and down a declined apron and through a nip formed by the leading edge of the apron and a baffle positioned therefrom at a level such that the slurry flow is directed vertically downward onto the base sheet formed on the fourdrinier wire passing under the nip.

Description of the Drawing

The Drawing is a perspective view of a secondsry headbox incorporating the features of my invention and illustrating the positioning of the headbox relative to a base sheet being formed on a conventional fourdrinier forming wire.

Description of the Preferred Embodiment

It is often desirable in a mineral board product to have a plurality of layers each of which gives the board a specific desirable function. In particular, it is desirable in some applications to have a relatively dense damage-resistant surfacing layer and a base layer which is of relatively low density so that, when the facing layer is perforated, the low density backing will act as an acoustic barrier and the board itself will retain its damage-resistant properties. By way of example, a method of forming such a product is described in a copending application of Booth et al, entitled "Method of Wet-Forming Mineral Fiberboard Product Having Damage-Resistant Overlay" and the disclosure of said application is incorporated herein by reference.

In the manufacture of a board product such as described using conventional fourdrinier equipment, it has been found to be necessary to design a secondary headbox, which is positioned over the low density base sheet being formed on the fourdrinier wire, which is capable of handling, mixing, distributing and applying the relatively high consistency slurry solution required for forming the continuous dense facing layer in a continuous wet-lay process.

With reference to the drawing, a perspective view of the secondary headbox of this invention is shown in place over a base sheet being formed on the forming wire of a conventional board-forming fourdrinier.

A relatively high density aqueous slurry is originally formed from the necessary board forming ingredients and flocculant using a hydrapulper and refiner and conventional (not shown) holding tanks from which it is pumped through a bifurcated slurry distribution header 5, into a first chamber 6. Here the slurry passes beneath an underflow baffle 7 and then into and through a driven perforated roll (holey roll) 8 wherein the slurry is mixed and evenly distributed across the width of the machine. The clearance between the underflow baffle 7 and the roll 8 is approximately 1/8 inch to 1/4 inch. The open area of the perforated roll 8 is evenly distributed and preferably constitutes between about 35 to 45 percent of the roll surface. Variable speed drive means 9 are provided for the holey roll 8.

From the holey roll 8 the slurry passes over a weir 10 into a second chamber 11. A baffle 12 is positioned from the wall 13 of the second chamber 11 and the slurry flows under the baffle 12 with the flow of the slurry through the second chamber being controlled by the spacing. The lower edge 14 of baffle 12 has a configuration designed to conform to the hydraulic flow of the slurry through chamber 11 so that any slurry turbulence is effectively dampened. Means 16 is provided for horizontal adjustment and means 17 is provided for vertical adjustment of baffle 12.

After passing through the second chamber 11, the slurry flows over a second weir 18 and down a declined apron 19 into a nip opening 20 formed by the leading or lip edge 21 of apron 19 and an adustable baffle 22 spaced therefrom. As shown in the drawing, means 23 are provided for pivotally adjusting baffle 22 and means 24 are provided for horizontal adjustment of baffle 22. The flow of the slurry onto the base sheet is controlled by the nip opening 20 and the slurry is directed vertically downward by baffle 22 which is in the path of slurry flow. The lower edge 25 of baffle 22 terminates in a straight edge parallel to apron lip 21 and is positioned from lip 21 and from 0 inches to 3 inches below lip 21.

The clearance of the baffle above the top 26 of base sheet 27 forming on wire 28 of the fourdrinier may be from about a minimum of 1/2 inch to a maximum of about 6 inches. Machine direction of the fourdrinier is as indicated in the drawing.

The various elements of the secondary headbox, such as the chambers 6 and 11, roll 8, baffles 7, 12 and 22, weirs 10 and 18 and apron 19, are positioned across machine direction and the surfaces of weirs 10 and 18 are in planes substantially parallel to the plane of wire 27. The shape of the inner walls at the lower parts of chambers 6 and 11 conform to the hydraulic configuration for the flow of the slurry. Preferably the declined apron 19 is at an angle of from about 30° to 45° from the horizontal.

I claim:

1. In combination with a board forming fourdrinier having a base sheet forming on the wire thereof, a secondary headbox capable of handling slurries of high solids consistencies positioned above and across the fourdrinier's machine direction, said headbox comprising:

a. a slurry feed header;

b. a first chamber into which the slurry from said header is introduced, said chamber including an underflow baffle beneath which the slurry initially passes and a driven perforated roll into and through which the slurry flows whereby the slurry is mixed and evenly distributed across the width of said chamber;

c. a first weir over which the slurry from the first chamber passes into a second chamber;

d. a second chamber having a baffle positioned therein under which the slurry flows, the lower edge configuration of said baffle conforming to the hydraulic flow of the slurry whereby any slurry turbulence is dampened, said baffle being positioned from the wall of said second chamber whereby the flow of the slurry through the chamber is controlled;

e. a second weir over which the slurry flows out of the second chamber onto a declined apron; and f. a baffle positioned from and forming a nip opening with the leading edge of said declined apron whereby slurry flow direction onto the base sheet is controlled, the lower edge of said baffle terminating in a straight edge parallel to the leading edge of the declined apron and positioned from 0 inches to about 3 inches below said leading edge whereby slurry flow is directed vertically downward onto the base sheet carried by the fourdrinier wire passing thereunder.

2. The combination of claim 1 wherein the surfaces of the first and second weirs are in planes substantially parallel to the plane of the fourdrinier wire and wherein the shape of the inner lower walls of the first and second chambers conform to the hydraulic configuration for the flow of the slurry passing therethrough.

3. The combination of claim 2 wherein the shaped baffle positioned in the second chamber is both horizontally and vertically adjustable and wherein the baffle positioned ahead of the leading edge of the declined apron is adjustable both vertically and horizontally relative thereto.

* * * * *